US007771649B2

(12) United States Patent
Shim et al.

(10) Patent No.: US 7,771,649 B2
(45) Date of Patent: Aug. 10, 2010

(54) METHOD OF PRODUCING ULTRAFINE CRYSTALLINE TIN/TIB$_2$ COMPOSITE CERMET

(75) Inventors: Jae Hyeok Shim, Seoul (KR); Ji Woo Kim, Suwon (KR); Young Whan Cho, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 443 days.

(21) Appl. No.: 11/942,147

(22) Filed: Nov. 19, 2007

(65) Prior Publication Data

US 2009/0129962 A1 May 21, 2009

(51) Int. Cl.
*B22F 3/12* (2006.01)

(52) U.S. Cl. ..... 419/12; 419/13; 419/14; 419/32; 419/34; 419/38

(58) Field of Classification Search ..... 419/32, 419/34, 12–14
See application file for complete search history.

(56) References Cited

U.S. PATENT DOCUMENTS 6,126,896 A * 10/2000 Choi ..... 419/32
7,217,390 B2 * 5/2007 Shim et al. ..... 419/38

FOREIGN PATENT DOCUMENTS

KR 10-2003-0085746 * 11/2003

* cited by examiner

*Primary Examiner*—Roy King
*Assistant Examiner*—Ngoclan T Mai
(74) *Attorney, Agent, or Firm*—Harness, Dickey & Pierce, PLC

(57) ABSTRACT

Disclosed herein is a method of producing an ultrafine crystalline TiN/TiB$_2$ composite cermet. In the method, titanium nitride (TiN)/titanium boride (TiB$_2$)/stainless steel composite nanopowder is produced through a reaction milling process using titanium (Ti), boron nitride (BN), and stainless steel powders as raw material powders, and the resulting composite nanopowder is liquid-phase sintered. The method comprises a first step of mixing titanium powder and boron nitride powder at a molar ratio of 3:2, a second step of mixing 5-60 wt % stainless steel powder and the powder mixture, a third step of feeding the powder mixture along with a ball having a predetermined diameter into a jar and conducting a high energy ball milling process to produce titanium nitride/titanium boride/stainless steel composite nanopowder, and a fourth step of shaping and sintering the resulting composite nanopowder.

8 Claims, 6 Drawing Sheets

METHOD OF PRODUCING ULTRAFINE CRYSTALLINE TIN/TIB$_2$ COMPOSITE CERMET

BACKGROUND OF THE INVENTION

1. Field of the Invention

The present invention relates to a method of producing an ultrafine crystalline TiN/TiB$_2$ composite cermet. More particularly, the present invention pertains to a method of producing an ultrafine TiN/TiB$_2$ cermet, in which titanium nitride (TiN)/titanium boride (TiB$_2$)/stainless steel composite nanopowder is produced through a reaction milling process using titanium (Ti), boron nitride (BN), and stainless steel powders as raw material powders and the resulting composite nanopowder is liquid-phase sintered.

2. Description of the Related Art

Titanium nitride is extensively used for cutting tools and wear-resistant parts due to its excellent wear resistance and high temperature strength. Since titanium boride has excellent high temperature oxidation and a very high elastic coefficient, it is not deformed at high temperatures, thus being used for bulletproof materials, cutting tools, and wear-resistant materials (Korean Patent Registration No. 456797).

In accordance with the recent emphasis on studies conducted to significantly improve the physical properties of cutting tools and high temperature wear-resistant materials, miniaturization is conducted, so that the size of a hard phase crystal is 1 μm or less, and two or more hard phases are dispersed to achieve combination thereof. Particularly, it is necessary to develop an ultrafine crystalline composite cermet in order to develop cutting tools for high precision processing, demand for which has recently increased.

According to known methods of producing an ultrafine crystalline composite cermet, a composite nanopowder having a crystalline size of 100 nm or less is produced using a gas phase method or a liquid phase method, and is then sintered (Korean Patent Registration No. 494976). However, the gas phase method and the liquid phase method are problematic in that the production cost is very high, productivity is low, and there is a high possibility of oxidation in the case of exposure to air, thus they are unsuitable for the mass production of raw material powder for the cermet.

SUMMARY OF THE INVENTION

Accordingly, the present invention has been made keeping in mind the above problems occurring in the prior art, and an object of the present invention is to provide a method of economically producing an ultrafine crystalline TiN/TiB$_2$ composite cermet, in which titanium nitride/titanium boride/stainless steel composite nanopowder is produced through a high energy ball milling process using titanium, boron nitride, and stainless steel powders as raw material powders, and the resulting composite nanopowder is liquid-phase sintered.

In order to accomplish the above object, the present invention provides a method of producing an ultrafine crystalline titanium nitride/titanium boride composite cermet. The method comprises a first step of mixing titanium powder and boron nitride powder at a molar ratio of 3:2, a second step of mixing 5-60 wt % stainless steel powder and the powder mixture, a third step of feeding the powder mixture along with a ball having a predetermined diameter into a jar and conducting a high energy ball milling process to produce titanium nitride/titanium boride/stainless steel composite nanopowder, and a fourth step of shaping and sintering the resulting composite nanopowder.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a detailed description will be given of constitutions and effects of embodiments of the present invention, referring to the accompanying drawings.

Figure 1:
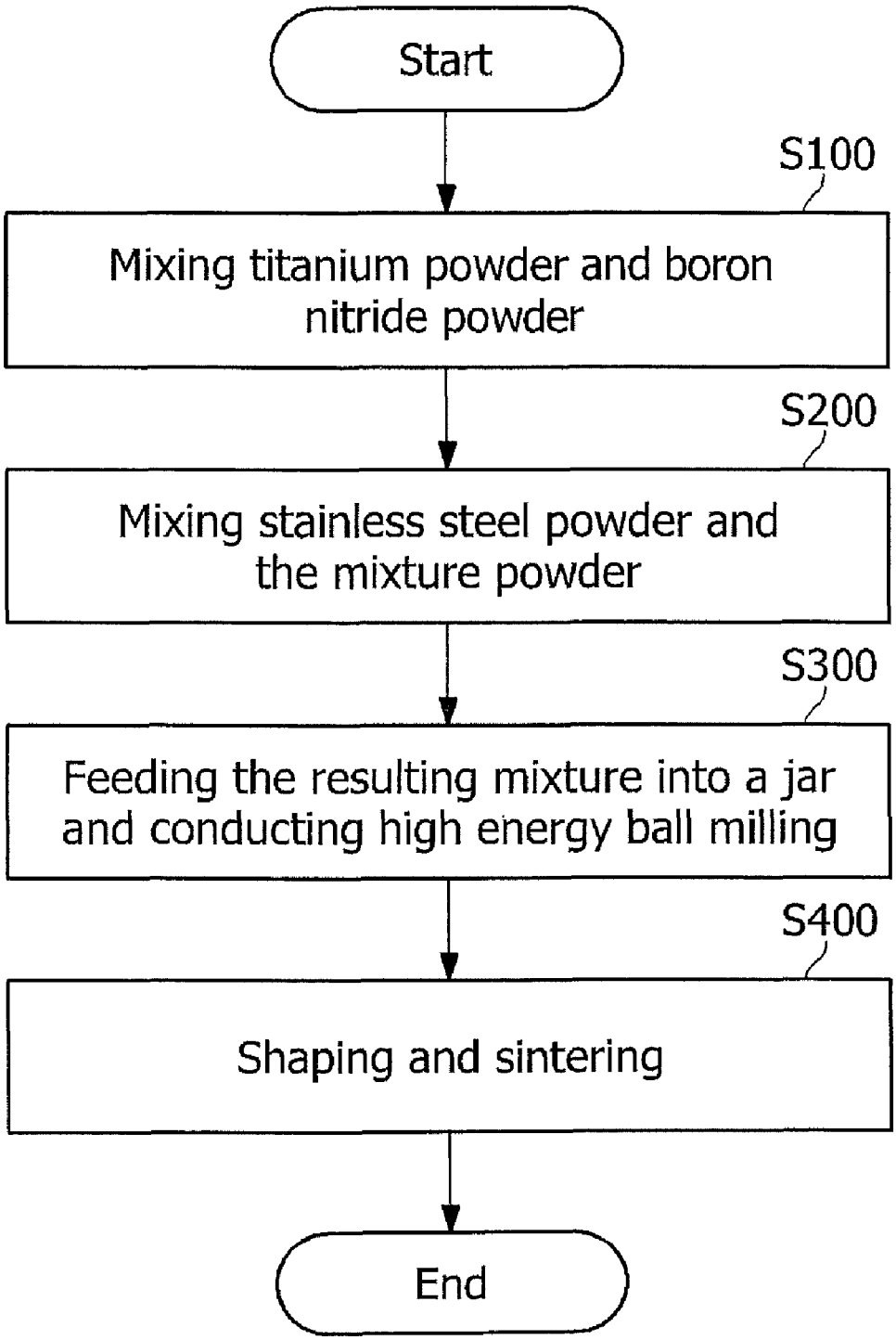
FIG. 1 illustrates a process of producing an ultrafine crystalline titanium nitride/titanium boride composite cermet according to the present invention.

FIG. 1 illustrates a process of producing an ultrafine crystalline titanium nitride/titanium boride composite cermet according to the present invention. As shown in FIG. 1, the ultrafine crystalline titanium nitride/titanium boride composite cermet is produced through the following procedure.

First, titanium powder having a purity of 95% or more and a particle size of 1 mm or less and boron nitride powder having a purity of 95% or more and a particle size of 1 mm or less are mixed at a molar ratio of 3:2 (S100), and 5-60 wt % stainless steel powder having a particle size of 1 mm or less is additionally mixed with the mixture (S200).

In connection with this, the stainless steel powder is a material which is converted into a liquid phase during a sintering process and thus acts as a metal matrix binder. The reason why its amount is limited to 5-60 wt % is as follows. If the amount is 5 wt % or less, the liquid phase is formed in a very small amount in the sintering process, thus titanium nitride and titanium boride particles are insufficiently sintered. If the amount is 60 wt % or more, since the amount of titanium nitride and titanium boride particles is relatively small, hardness of the resulting cermet is very low.

The mixture is charged along with a ball, which is made of tool steel, stainless steel, hard metal, silicon nitride, alumina, or zirconia and has a diameter of 5-30 mm, at a weight ratio of 1:1-1:100 into a jar made of tool steel, stainless steel, hard metal (WC-Co), silicon nitride, alumina, or zirconia.

In connection with this, the reason why the weight ratio of the mixture and the ball is limited to 1:1-1:100 is as follows. If the weight ratio is 1:1 or less, the degree of milling is too low to facilitate the chemical reaction of the powder. If the weight ratio is 1:100 or more, the degree of milling is very high, thus the material (for example, Fe) of the ball or the jar may be added to the powder mixture as an impurity.

Next, argon or nitrogen is charged into the jar, and a high energy ball milling process is then conducted using a shaker mill, a vibratory mill, a planetary mill, or an attritor mill for 1-20 hours (S300). The reaction shown in Chemical Equation 1 is achieved through the high energy ball milling process, and composite powder of titanium nitride and titanium boride mixed at a molar ratio of 2:1 is produced.

Chemical Equation 1

$$3Ti+2BN=2TiN+TiB^2$$

The reason why the milling time is limited to 1-20 hours is as follows. If the milling time is 1 hour or less, the reaction of Chemical Equation 1 may be insufficiently conducted, and the particle size does not reach the nm size even if the reaction is sufficiently conducted. If the milling time is 20 hours or more, impurities from the ball or the jar may be incorporated.

The powder, which is obtained through the high energy ball milling process, is collected and then shaped, and the resulting shaped body is sintered in a vacuum of $10^{-2}$ torr or less, an argon atmosphere, or a nitrogen atmosphere at 1300-1600° C.

In connection with this, the reason why the sintering temperature is limited to 1300-1600° C. is as follows. If the sintering temperature is 1300° C. or less, fusion of the stainless steel powder does not occur, thus liquid phase sintering is not conducted. If the sintering temperature is 1600° C. or more, the titanium nitride and titanium boride particles are excessively grown during the sintering process, thus physical properties of the sintered body are reduced and titanium nitride is decomposed at a high temperature.

A better understanding of the present invention may be obtained through the following example which is set forth to illustrate, but is not to be construed as the limit of the present invention.

Titanium powder having a purity of 99.9% and a particle size of 45 μm and boron nitride powder having a purity of 99% and a particle size of 4 μm were mixed at a molar ratio of 3:2, and 40 wt % 316L stainless steel powder having a particle size of 45 μm or less was additionally mixed with the mixture.

The mixture was loaded along with balls, which were made of hard metal and had a diameter of 9.5 mm, at a weight ratio of 1:20 into a jar made of tool steel, argon was charged into the jar, and a high energy ball milling process was conducted using a planetary mill for 4 hours. The milled powder was collected and then shaped under a pressure of 25 MPa, and the shaped body was sintered in a vacuum of 0.1 torr or less at 1500° C. for 2 hours (S400).

Figure 2:
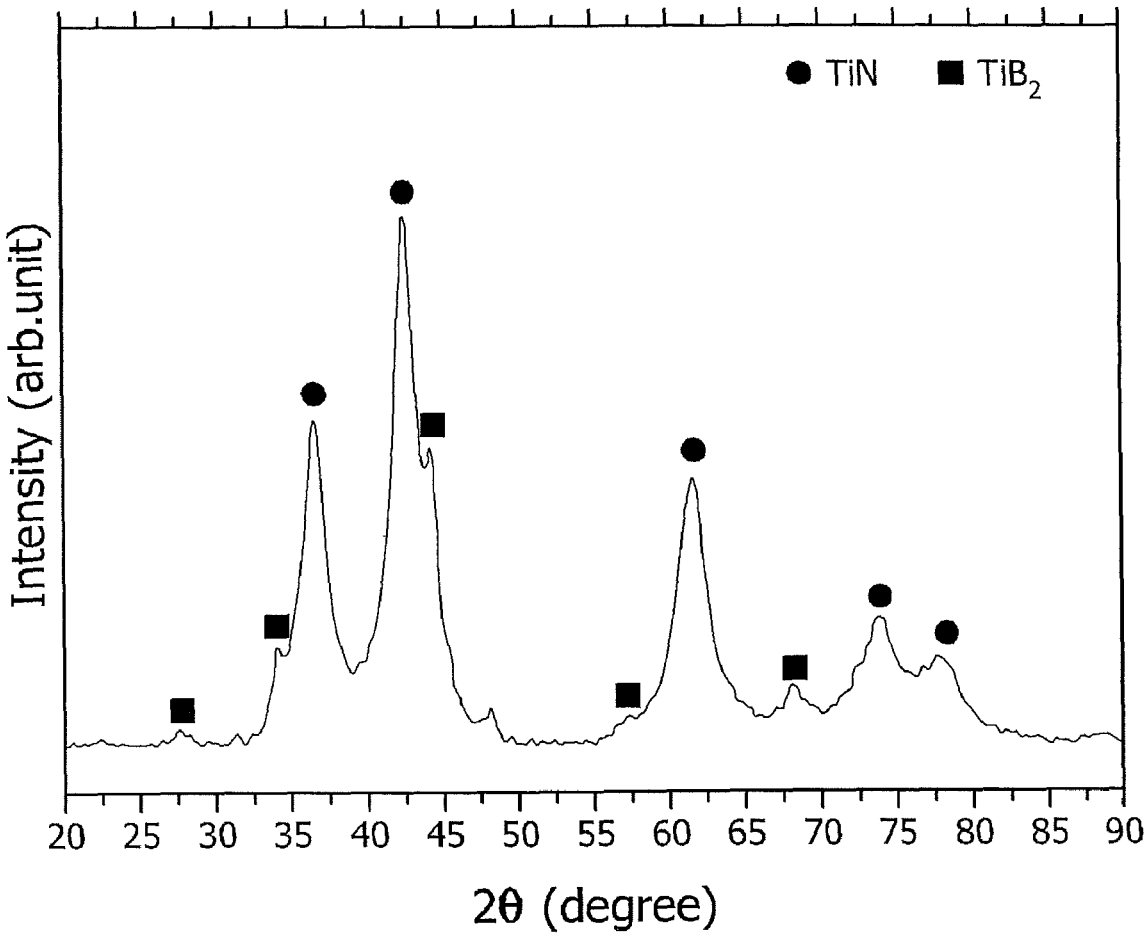
FIG. 2 is an X-ray diffraction pattern of powder subjected to a high energy ball milling process according to the present invention.

FIG. 2 is an X-ray diffraction pattern of powder, subjected to a high energy ball milling process, according to the present invention. As shown in FIG. 2, it is confirmed that titanium, boron nitride, and stainless steel powders before the milling were converted into titanium nitride and titanium boride after the milling.

A stainless steel peak is not observed in the X-ray diffraction pattern because the particles of stainless steel become very small and thus amorphous during the milling process.

Figure 3:
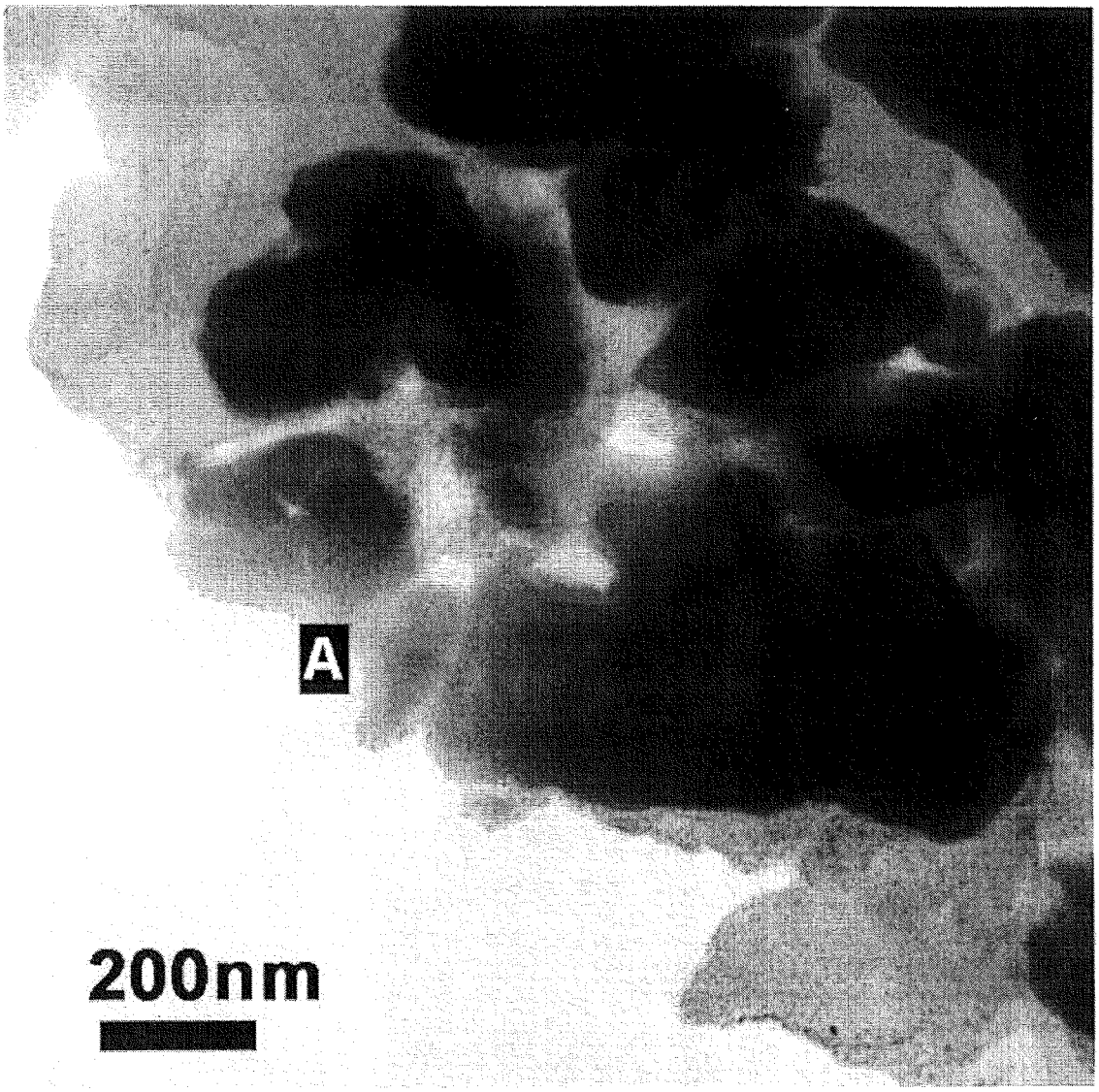
FIG. 3 is a transmission electron microscope picture of powder subjected to the high energy ball milling process according to the present invention.

FIG. 3 is a transmission electron microscope picture of the powder, subjected to the high energy ball milling process, according to the present invention. As shown in FIG. 3, the powder particles each have an irregular shape and an average particle size of about 0.3 μm.

Figure 4:
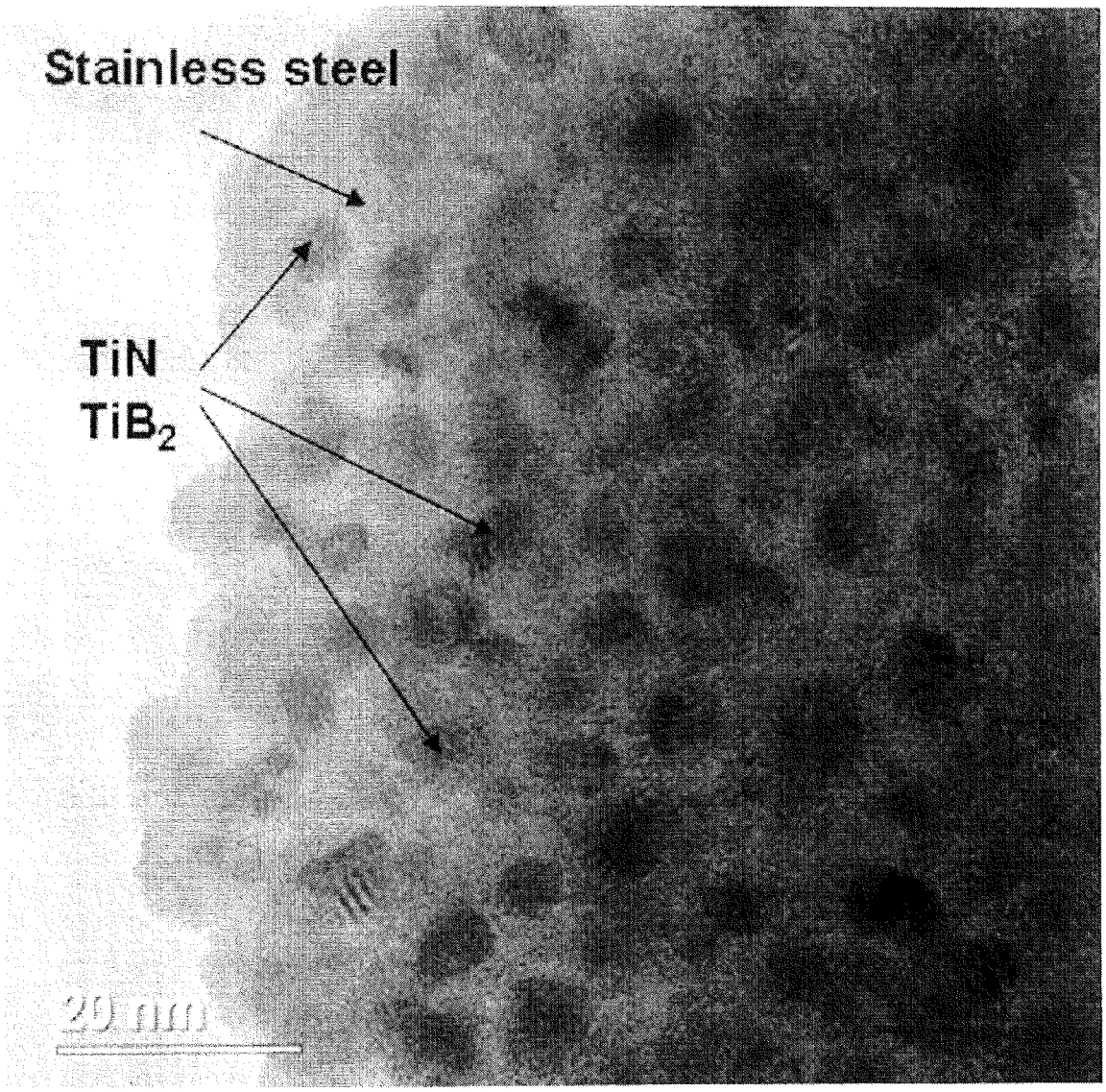
FIG. 4 is a picture showing internal structures of particles of the powder of FIG. 3, which is taken using a high resolution transmission electron microscope.

FIG. 4 is a picture showing internal structures of particles of the powder of FIG. 3, taken using a high resolution transmission electron microscope. From FIG. 4, it can be seen that polygonal crystalline titanium nitride and titanium boride particles having a particle size of 5-15 μm are very uniformly dispersed on an amorphous stainless steel matrix.

Figure 5:
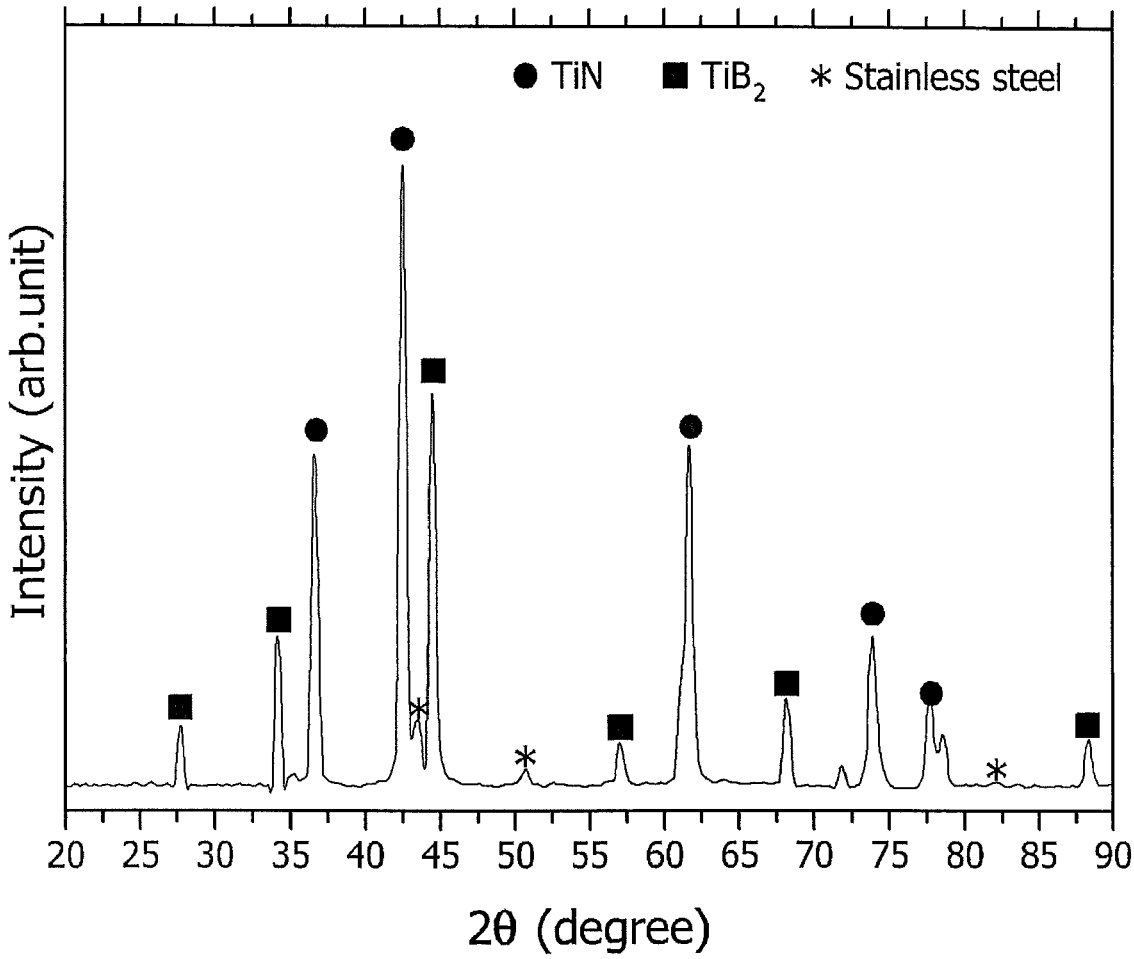
FIG. 5 is an X-ray diffraction pattern of a titanium nitride/titanium boride composite cermet, which is obtained by sintering composite nanopowder produced using the high energy ball milling process, according to the present invention.

FIG. 5 is an X-ray diffraction pattern of a composite cermet of titanium nitride/titanium boride, which is obtained by sintering a composite nanopowder produced using the high energy ball milling process, according to the present invention. From FIG. 5, it can be seen that phase transition does not occur during the sintering process, and the peak of stainless steel caused by crystallization after fusion can be confirmed.

The height of the peak increases and a width thereof is reduced in comparison with the powder after milling, which signifies that crystalline particles were grown during the sintering process.

Figure 6:
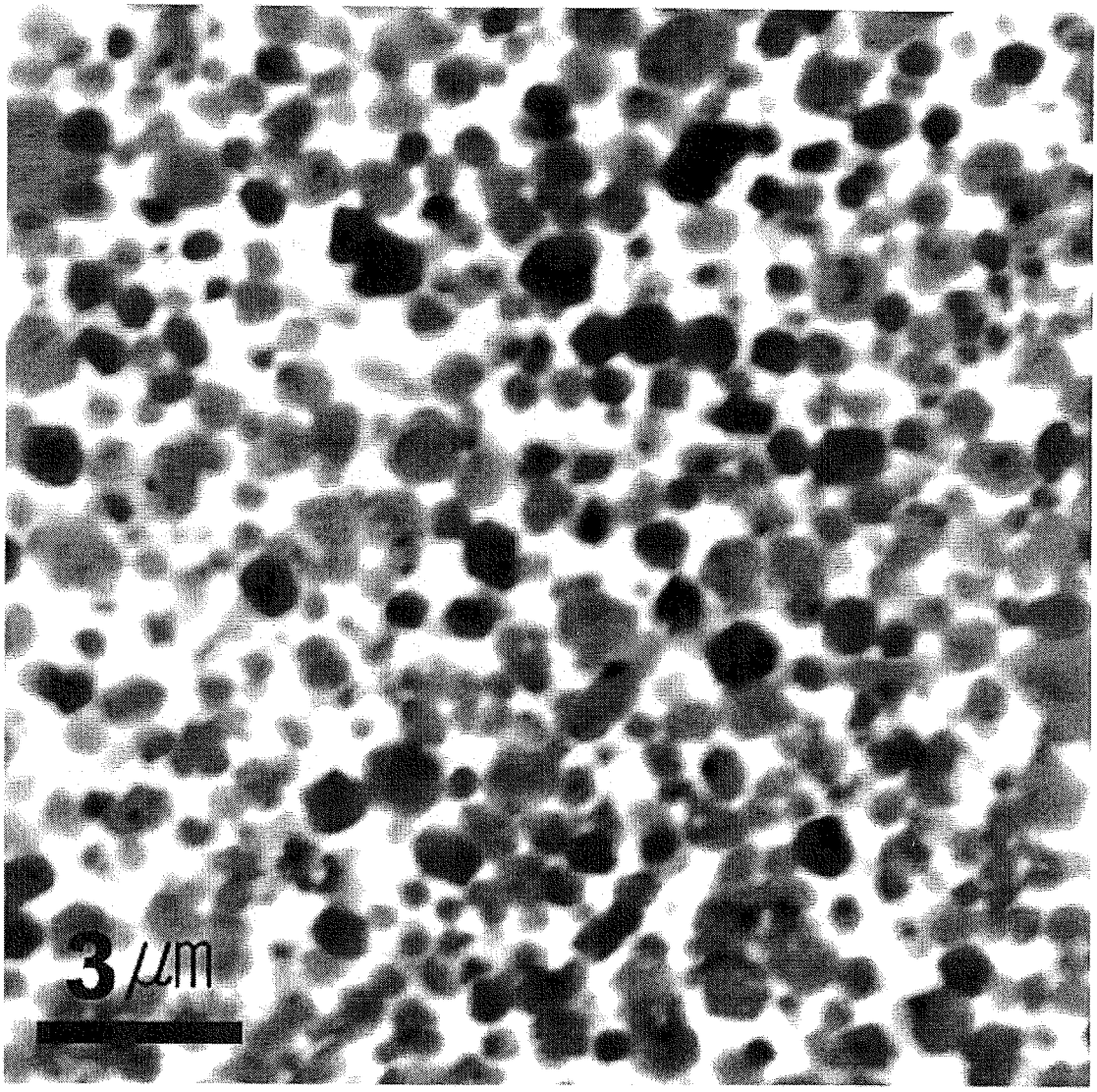
FIG. 6 is a scanning electron microscope picture of a microstructure of the titanium nitride/titanium boride composite cermet, which is obtained by sintering the composite nanopowder produced using the high energy ball milling process, according to the present invention.

FIG. 6 is a scanning electron microscope picture of the microstructure of the titanium nitride/titanium boride composite cermet, obtained by sintering the composite nanopowder produced using the high energy ball milling process, according to the present invention. From FIG. 6, it can be seen that polygonal ultrafine titanium nitride and titanium boride particles, having a diameter of 1 μm or less, are uniformly dispersed on a stainless steel matrix.

Pores are not observed, and the measured density of the sintered body approaches a theoretical density (99% or more), which signifies that the sintering was conducted very well.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As described above, in a method of producing an ultrafine crystalline titanium nitride/titanium boride composite cermet which has a very small crystalline particle size of 1 μm or less according to the present invention, titanium, boron nitride, and stainless steel powders are used as raw materials, and a titanium nitride/titanium boride/stainless steel composite nanopowder having a crystalline particle size of 10 nm or so, which is produced using a high energy ball milling process, is sintered.

Thereby, it is possible to relatively simply and economically produce a novel composite cermet alloy having a microstructure which is difficult to produce through a conventional method.

What is claimed is:

1. A method of producing an ultrafine crystalline titanium nitride/titanium boride composite cermet, comprising:

a first step of mixing titanium powder and boron nitride powder at a molar ratio of 3:2;

a second step of mixing 5-60 wt % stainless steel powder and a powder mixture;

a third step of feeding the powder mixture along with a ball having a predetermined diameter into a jar and conducting a high energy ball milling process to produce titanium nitride/titanium boride/stainless steel composite nanopowder; and a fourth step of shaping and sintering the resulting composite nanopowder.

2. The method as set forth in claim 1, wherein the titanium powder, the boron nitride powder, and the stainless steel powder each have a purity of 95% or more and a particle size of 1 mm or less.

3. The method as set forth in claim 1, wherein a material of the jar and the ball is any one of tool steel, stainless steel, hard metal, silicon nitride, alumina, and zirconia.

4. The method as set forth in claim 1, wherein a diameter of the ball is 5-30 mm, and a weight ratio of the powder mixture and the ball fed into the jar is 1:1-1:100.

5. The method as set forth in claim 1, wherein the high energy ball milling process is conducted using any one of a shaker mill, a vibratory mill, a planetary mill, and an attritor mill.

6. The method as set forth in claim 1 or 5, wherein the high energy ball milling process is conducted for 1-20 hours.

7. The method as set forth in claim 1, wherein the high energy ball milling process is conducted after argon or nitrogen is charged into the jar.

8. The method as set forth in claim 1, wherein a shaped body is sintered in any one atmosphere of a vacuum of 10-2 torr, an argon atmosphere, and a nitrogen atmosphere at 1300-1600° C.

* * * * *